United States Patent [19]

Trevillion

[11] Patent Number: 4,771,635

[45] Date of Patent: Sep. 20, 1988

[54] FLUID INJECTOR FOR TRACER ELEMENT WELL BOREHOLE INJECTION

[75] Inventor: William L. Trevillion, Houston, Tex.

[73] Assignee: Halliburton Company, Duncan, Okla.

[21] Appl. No.: 8,228

[22] Filed: Jan. 29, 1987

[51] Int. Cl.[4] ..... E21B 47/10

[52] U.S. Cl. ..... 73/155

[58] Field of Search ..... 73/155; 166/250; 250/259, 260

[56] References Cited

U.S. PATENT DOCUMENTS 3,406,284 10/1968 Young ..... 250/260

4,662,218 5/1987 Hawthorne ..... 250/260 X

*Primary Examiner*—Jerry W. Myracle

*Attorney, Agent, or Firm*—William J. Beard

[57] ABSTRACT

The present disclosure is directed to a tracer fluid injector apparatus adapted to be lowered in a well borehole. In a sonde preferably equipped with a radioactive detector, a fluid injector system is disclosed. It utilizes an isolated cartridge of cylindrical construction having two closed ends. A piston in the cartridge moves to assure compression of a tracer fluid in the cartridge. It is installed or removed from the sonde at a specified cavity in the sonde. When placed therein, a bayonet stabs into the cartridge to open the cartridge for controlled flow of tracer fluid. The bayonet connects through appropriate check valves to a pump which delivers tracer fluid at a controlled metering means including an orifice on the exterior of the sonde so that radioactive tracer fluid is carefully handled by the present apparatus. A method of operation is also set forth.

10 Claims, 4 Drawing Sheets

FIG. 1
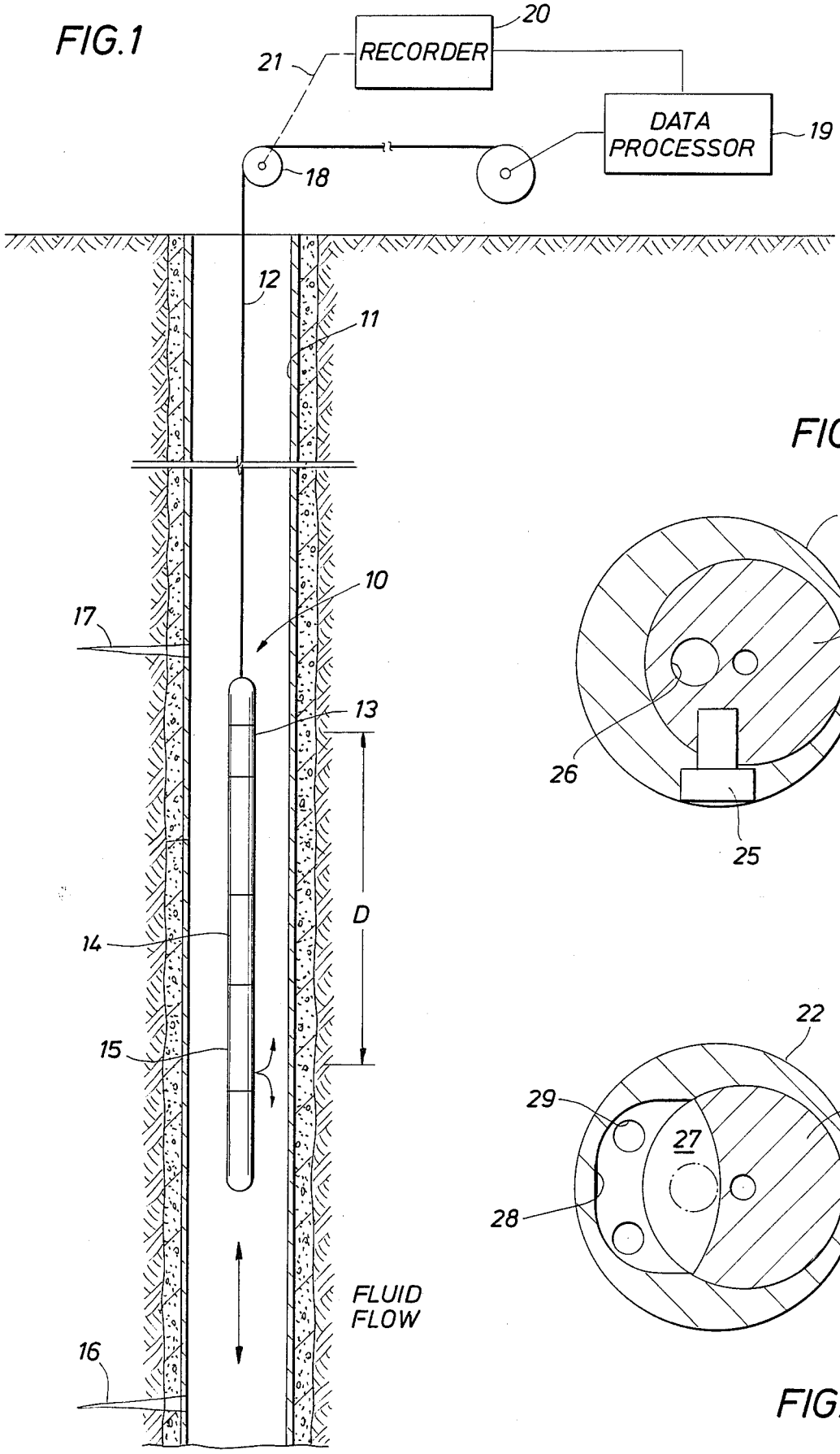
FIG. 3
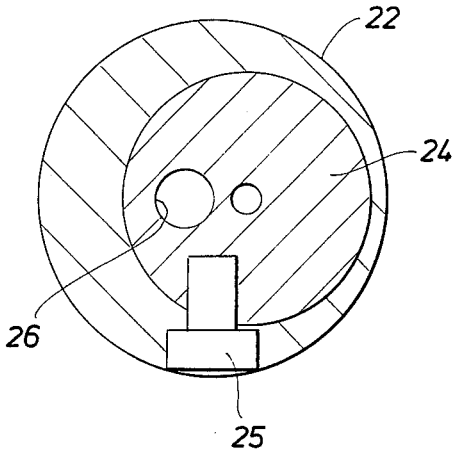
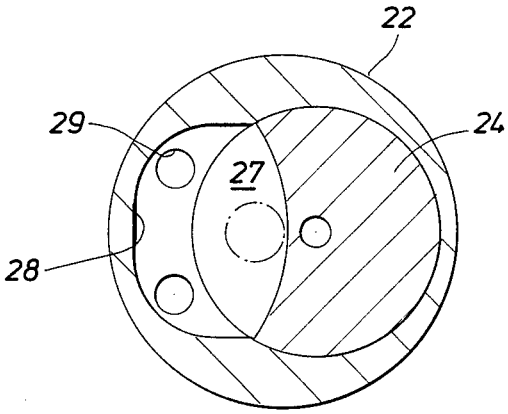
FIG. 4

FLUID INJECTOR FOR TRACER ELEMENT WELL BOREHOLE INJECTION

BACKGROUND OF THE DISCLOSURE

After a well has been produced and fluid production is obtained from one or more zones of the well, it is necessary to measure the rate of flow in the well. When it is a single formation producing into the well, the rate of flow at the formation is the same as the rate of flow from the wellhead. Thus, the rate of production from a formation that several thousand feet deep can be quickly known by measuring the rate of flow from the wellhead. This simple case however does not apply where there is more than one producing formation. It is possible that both formations will produce. It is also possible that one of the formations will later fail to produce and will draw off production. Thus, the rate of production at the two formations can vary widely even to the point where production is actually lost from one formation into another. Measurement at the well head may yield the net production but it does not yield the individual formation production rates.

Production from a formation is an important parameter in well control. For instance, different types production equipment can be installed. Different production enhancement techniques can be used including various fracture techniques and the like. Such fracture techniques and production enhancement techniques are materially assisted if the rate of production from a formation is known, or indeed the fact that loss into a particular formation has occurred. The present apparatus is particularly useful in determining rate of production. It is particularly adapted to be used in a cased well which intersects one or more horizons having perforations through the casing into the horizons.

In view of the fact that the well is cased, the cross sectional flow area along the well is then known. The present apparatus is an injector which delivers a controlled flow of a tracer fluid. The tracer fluid is injected into the cased well, and its passage is noted further up the well. Tracer passage is detected by means of a suitable radioactivity detector. In this measurement, a geiger tube or a scintillation detector measuring device can be used. If the time at which the tracer fluid is injected into the fluid flow in the cased well is known, then the fluid is measured at the moment it passes the detector. This elapsed time for travel over a known distance can be used in conjunction with knowledge of the dimensions of the cased well to provide an indication of flow rate.

It will be appreciated that the handling of the tracer fluid is a critical matter. So to speak, the tracer fluid should be delivered only on command and such delivery should be controllable. That is, the tracer element delivery should be carefully timed for onset and volume. The present apparatus is a device which enables careful delivery and controlled volumetric flow of tracer. It is particularly adapted to be incorporated in a sonde for delivery of the tracer into the fluid flow in the well so that production can be measured by observation of the passage of the tracer element.

The present apparatus is an injector incorporated in a sonde. It fits in an elongate tubular structure. It has a separate, removable cartridge which is filled with the radioactive fluid. The cartridge is a separate unit which can be plugged into the housing in a suitable receptacle. Since it is a separate cartridge, this assures safe handling, both before and after use, thereby assuring that the radioactive material in the housing does not escape. This avoids contamination problems. Moreover, this technique of installation of the cartridge in the injector permits selective change of injector cartridge and also selective change of tracer. The present apparatus thus incorporates a separate cartridge, a check valve system, a pump system operated by a controllable solenoid drive mechanism and an outlet through a sized orifice. This assures controllable injection of the tracer into the well fluid.

While the foregoing touches on the apparatus which is involved in this disclosure and also discusses the method of use, more details will be observed on a review of the detailed description found below.

IN THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

FIG. 1 shows the injector of the present disclosure suspended in a cased well in a sonde which also incorporates shielding and a detector for determining rate of flow in the well;

FIG. 3–6 are transverse sectional views along the tool illustrated in FIG. 2.

DETAILED DESCRIPTION OF THE PREFERRED EMBODIMENT

Figure 2E:
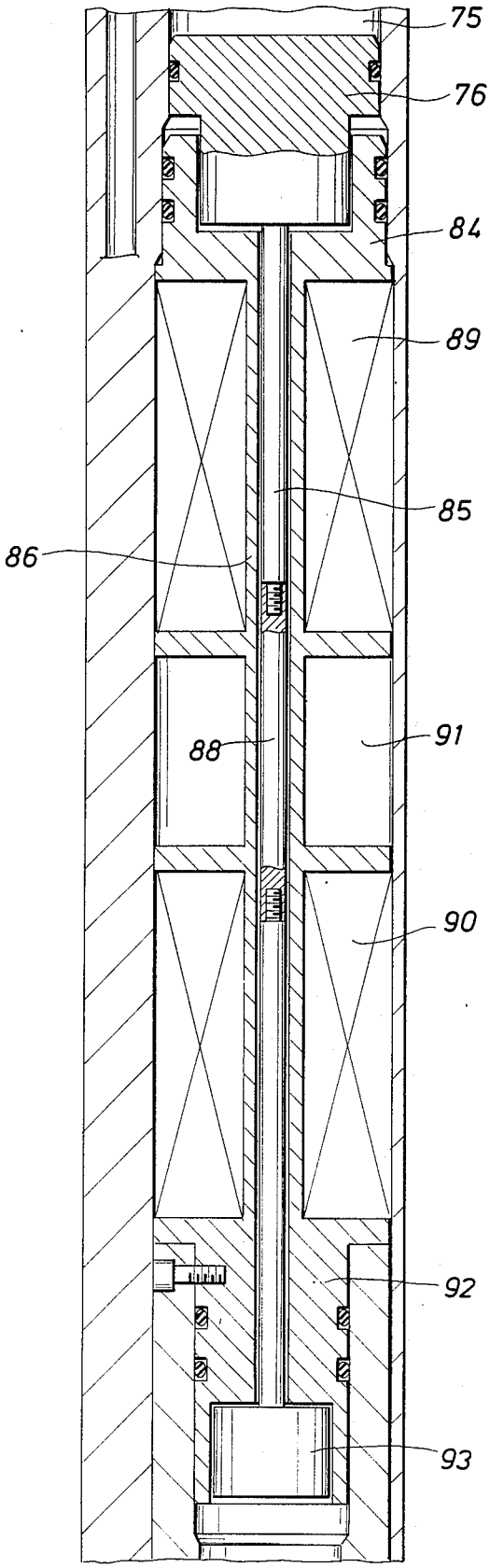
FIG. 2 is a detailed sectional view (in segments A through E) through the injector apparatus of the present disclosure showing details of construction.
Figure 5:
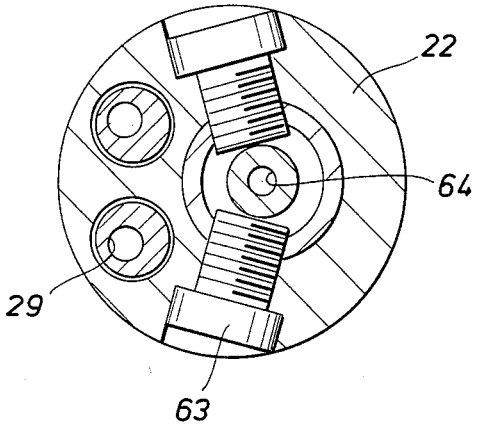
Figure 6:
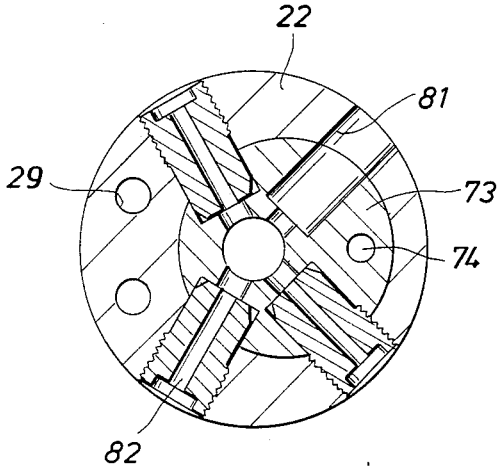

Attention is first directed to FIG. 1 of the drawings where a sonde 10 is lowered into a cased well, the casing being identified by the numeral 11. It is supported on an armored logging cable 12. The sonde 10 incorporates a detector 13. The detector is typically a geiger tube or scintillation counter. The detector 13 is isolated by a shield 14 from the radioactive material therebelow. The shield 14 typically is lead or some other suitable material providing shielding from the radioactive tracer which is carried in the sonde 10. The injector of the present disclosure is identified at 15 and is constructed in the sonde 10. The deployment of the detector 13 spaced from the injector 15 should be noted. They are spaced apart by a distance D which is a known measure. The distance between the two components is a factor important to making certain measurements as will be described. The sonde 10 is raised on the cable 12. It is typically raised in the well borehole at a velocity $V_s$. Measurements can be made while the sonde is still, or when the sonde is moving at this velocity. The cased well is penetrated by a lower set of perforations 16, and there is also an upper set of perforations at 17. Through the use of suitable measuring devices, the actual production from the well can be obtained at the wellhead. As will be understood, the perforations at 16 and 17 are presumed to enter producing formations; the present apparatus is able to measure the fluid flow from the formations into the cased well.

The cable 12 extends upwardly and passes over a sheave 18. The sheave directs the cable to a drum where it is spooled and stored. The data from the apparatus in the sonde 10 is delivered through the cable 12 for input to a data processor 19. The data processor provides output data which is delivered to a recorder 20. The recorder 20 is connected by an electronic or mechanical depth measuring apparatus indicated generally at 21 which measures travel of the cable, this apparatus typically operating at the sheave 18. This enables recording of data as a function of depth of the sonde 10 in the well.

Assume for purposes of discussion that the production or volume obtained at the surface is represented by the symbol $Q_t$. This is typically measured in a rate of gallons or barrels per minute. Also, assume that there are individual volumes produced at the two separate sets of perforations and thus one has volumes $Q_{16}$ and $Q_{17}$ from the respective two horizons. Clearly, the total volume produced $Q_t$ is equal to the sum of the two volumes from the formations, or $Q_{16}$ and $Q_{17}$. While one might assume that $Q_{16}$ and $Q_{17}$ are both positive, it is possible that one might be negative. Keeping these definitions in view, next consider construction of the injector 15, and for this purpose, attention is now directed to FIG. 2 of the drawings. Going now to the top end of FIG. 2, it will be observed that the sonde 10 has been broken away to particularly illustrate the construction of the injector 15. The other components in the sonde 10 are believed to be well known to one of ordinary skill in this particular art. The description will therefore precede from the top end of FIG. 2 where the sonde is shown illustrated in sectional view in greater detail.

The sonde is formed of tubular stock. This is defined as a cylindrical body 22. The body 22 the cylindrical on the exterior; it is drilled with a circular cavity on the interior but the circular hole is not concentric. The hole is offset to one side. The circular hole receives the various components including the tracer cartridge as will be described. It is offset to one side to provide a relatively thick portion on the opposite side, the thick portion permitting room typically for two small drilled holes extending along the sonde 10. These small holes are included to receive various control lines and electrical wires. The wires will not be shown in view of their deployment out of the way, so to speak.

The sonde is constructed so that it disassembles at some place just above the start of the sectional view shown in FIG. 2. This defines an internal cavity at 23. The cavity 23 is a large diameter hole. A plug 24 is positioned in the cavity. The plug is sealed on the exterior by suitable seal rings. The plug is held in location by inserting a bolt 25 into the tubular member 22 at a lateral drilled hole for receiving the bolt (FIG. 3).

The plug 24 has a lengthwise passage 26 opening into a chamber 27 to receive electrical fittings. The fittings align in an undercut chamber 28 at the top end of passages 29 to enable electrical connections to be made. These are also shown in FIG. 4.

The plug 24 plugs the cavity 23 which extends along the length of the body 22. Small passages extend along the length of the tool to provide the necessary space for the conduits essential to operation of the equipment as will be described. From this juncture forward, the small passages 29 on the side will not be discussed. Should they be omitted, the cavity 23 could be drilled concentric of the body. As it is, it is helpful to form the cavity 23 off center as illustrated in the drawings to provide the extra area where the conductors are located. This arrangement of placing the cavity 23 off center will be observed along the length of FIG. 2.

The cavity 23 is plugged by the plug 24 after a cartridge 30 has been placed in the cavity. The cartridge 30 is a detachable unitary structure. The cartridge 30 incorporates a top closure member 31. The closure member threads to a cartridge cylinder 32. The cartridge 30 stabs into the cavity 23 and is seated in the lower end of the cavity. This operation is accomplished rather easily; the elongate cylindrical cartridge (as a single unit) is placed in the cavity and is pushed to the bottom of the cavity. Moreover, the cavity is longer than the cartridge to leave an open space. The plug 24 plugs the top end of the cavity 23.

The closure plug 31 closes the top end of the cartridge. The cartridge is typically formed of metal and in this regard, it is not possible to see the interior to determine whether or not it holds a tracer. After it is filled with a tracer, an indication of filling is obtained by means of an indicator rod 33. The rod 33 passes through the closure plug 31 and extends out of the cartridge 30. No leakage occurs along the rod 33 because it is sealed at the closure plug 31 where it passes axially through a hole in the plug. The rod 33 connects at its lower end to a movable piston 34. The piston 34 fits snugly inside the cylinder 32 which makes up the cartridge. It seals against the inner wall except at the extremity of movement towards the bottom where the wall is slightly cut with a shallow groove 35. This assures that the tracer in the cartridge can bypass the piston plug. Tracer is able to flow downwardly to fully empty the cartridge after the cartridge is filled with tracer. If desired, a small bubble of highly compressed inert gas such as nitrogen can be placed in the top of the cartridge. The cartridge is installed vertically so that the gas collects at the upper end and can expand as a gas drive, forcing the tracer out of the cartridge.

The cartridge is formed with a thin wall member 32 which extends to the lower end, and it there joins to a bottom cartridge sub 36. The sub 36 threads to the cylinder shell 32. The bottom sub 36 is centrally drilled so that it encloses a bayonet as will be described. On the interior of the cartridge, the bottom sub 36 supports an upstanding skirt 38 which serves as a cage surrounding a ball valve element. A coil spring 39 bears against the ball 40 and forces it to a closed position inside the cage 38. There is a tapered seat 41 which receives the ball 40 and seals thereagainst, preventing leakage from the cartridge. The coil spring 39 abuts against a threaded cap 42 over the spring 39, capturing the spring and ball and assuring that the spring bears against the ball. The spring 39 is captured in a spool 43, the spool 43 bearing against the ball element 40 to assure even distribution of the force against the ball. This prevents the ball from moving to the side and captures the ball against the appropriately tapered seat. There is a flow path through the cap 42, this being a drilled passage 44. This enables fluid to flow down in the vicinity of the ball 40. There is an additional flow path 45 to the valve seat 41 when the ball is in the up position as shown in FIG. 2. In the down position, flow from the cartridge is prevented by the check valve arrangement defined by the ball 40 and the valve seat 41.

Directing attention further to the arrangement shown in FIG. 2, the cartridge, when outside the cavity 23, comprises an elongate cylindrical body with a recess at the lower end. The ball 40 operates as a check valve to prevent leakage. It is spring loaded by the spring 39 to assure closure. When it is time to open the cartridge to deliver the radioactive tracer, the ball 40 is upset. this is accomplished by a means of a bayonet member 48. The bayonet 48 is an elongate hollow cylindrical member having a tip at 49, the tip 49 being sized and shaped to stab through the valve seat 41 to force the ball 40 off the valve seat. When this occurs, it opens a flow path through the valve seat 41. The bayonet is axially hollow, being provided with a passage at 50, the passage 50 opening through a number of ports 51. The ports 51 communicate from the valve seal 41 to define the continued flow path. When the ball 40 is dislodged, there is a flow path out of the cartridge through the valve seat 41 past the dislodged valve element 40. This flow path is into the passage 50. The bayonet 48 stands above a transverse shoulder 52, the shoulder 52 limiting travel of the sub 36 defining the bottom end of the cartridge. The cartridge bottoms against the shoulder 52.

Figure 2C:
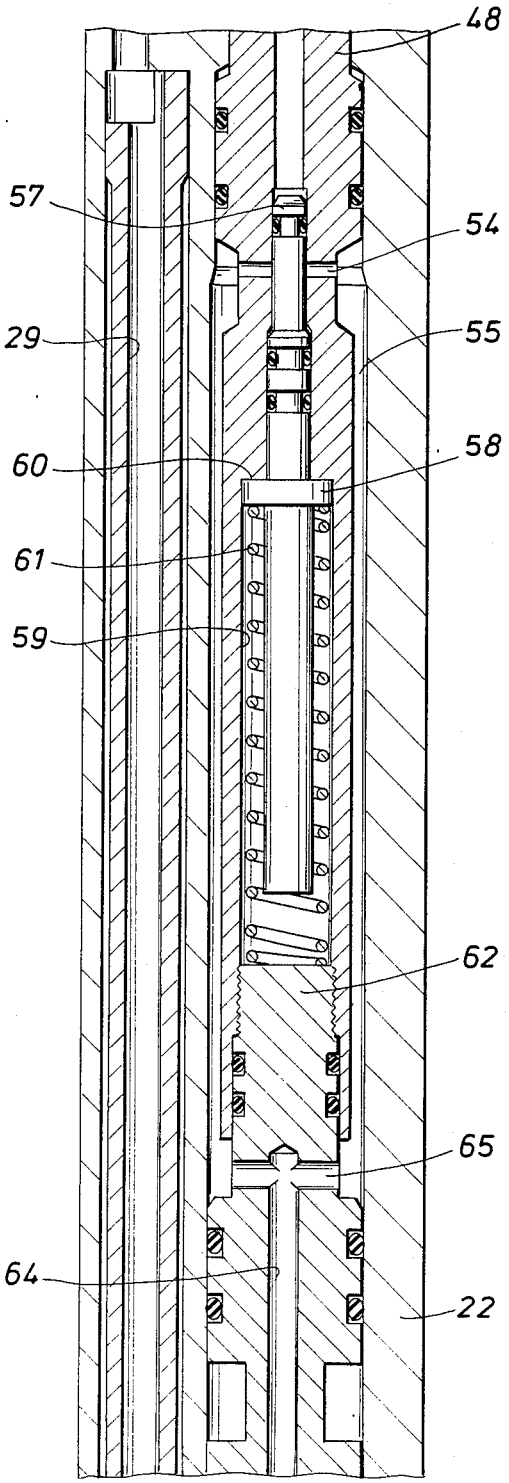
Figure 2D:
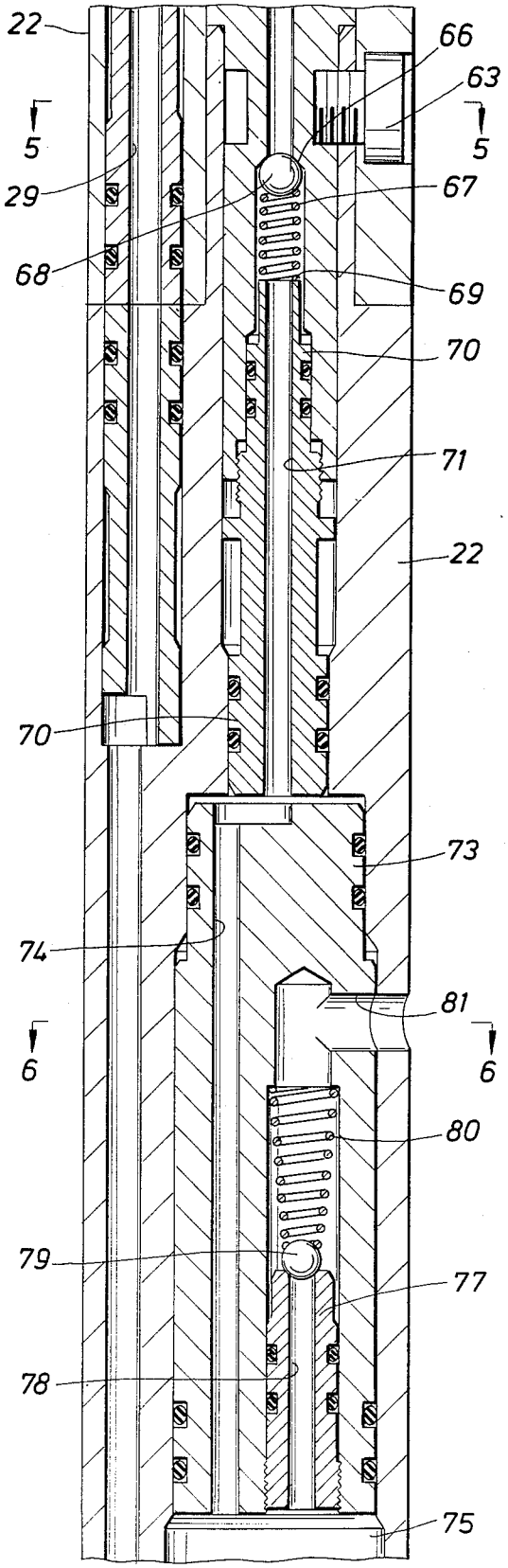
Figure 2A:
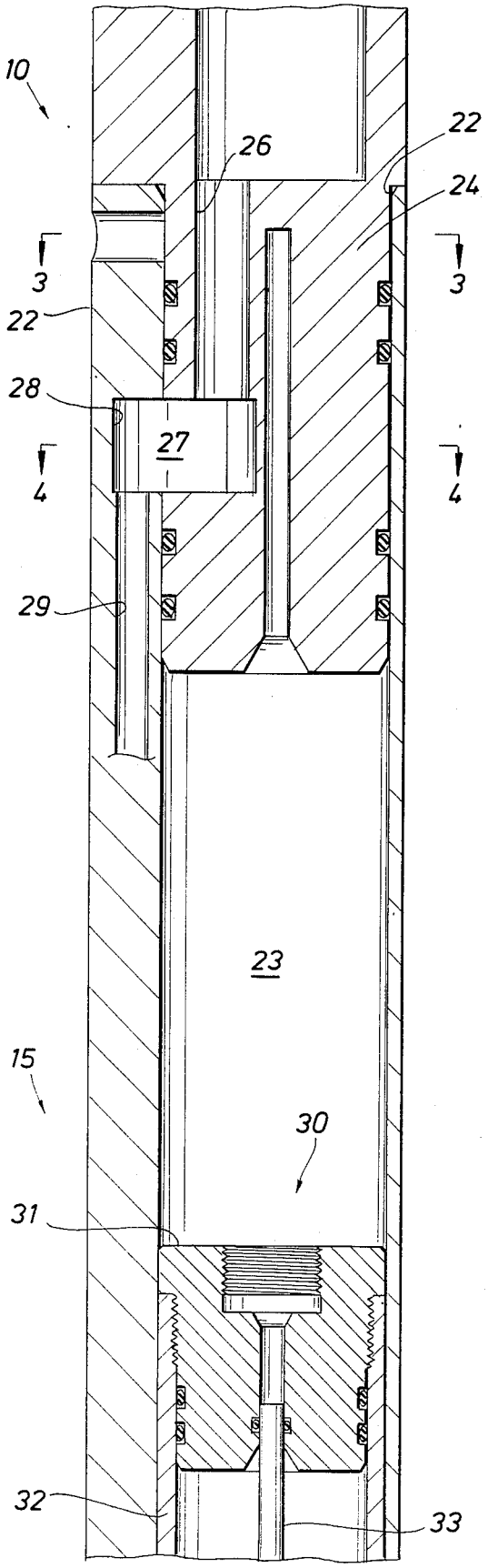
Figure 2B:
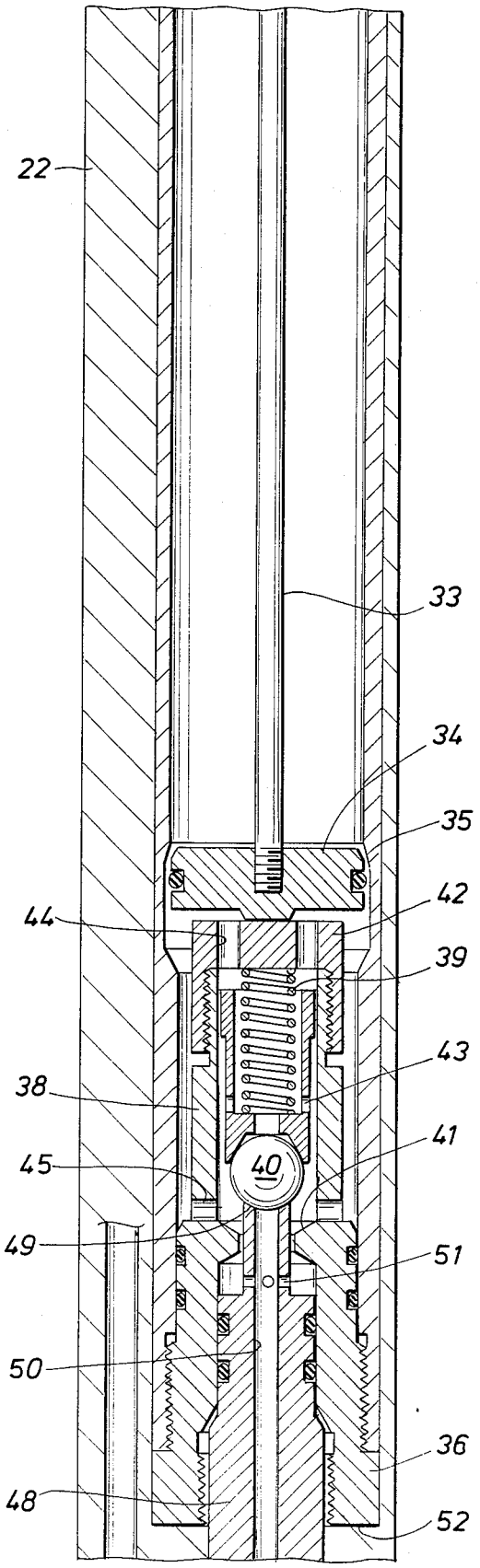

Continuing with FIG. 2C, the bayonet passage 50 connects with several radially directed ports 54 to the exterior of the bayonet member. There is an annular space 55 which provides the downwardly extending flow path. Fluid flow from the bayonet passage 50 into the angular flow space 55 is controlled by a check valve arrangement. The check valve includes a check valve stem 57 supported so that it seals against the passage 50 upstream of the ports 54 to block fluid flow. The stem 57 is connected with an enlarged stem piston 58. The stem piston 58 is received in a chamber 59 around the stem, the piston being limited in travel by a downwardly facing shoulder 60. The shoulder limits upward travel of the bayonet check valve stem 57. A coil spring 61 below the piston 58 forces it upwardly. The piston is urged upwardly by the spring 61. The lower end of the spring bears against a closure plug 62. The plug 62 is threaded in the bayonet member. The bayonet member thus extends from the ball 40 to the plug 62. The coil spring 61 is selected to have a force sufficient to close off the passages 54. The spring is overcome when there is sufficient well pressure acting on the check valve.

The plug is an elongate structure fitted into a drilled passage in the body 22. This passage extends along the body 22 formed of multiple parts for assembly and disassembly purposes. The parts are bolted together by bolts 63. Just below the plug 62, an axial passage 64 opens to the annular space by means of ports 65. This defines a continuous pathway for fluid flow connecting with the annular space 55 extending along the bayonet. The flow path 64 is axially along the plug body.

In FIG. 20, the long plug body 62 has in internal passage 64 which becomes larger at an internal seat 66. A spring 67 urges a check valve element 68 against the seat 66 above an opening 69 formed at the end of a tubular fitting 70. This check valve permits flow into the tubular fitting 70. The tubular fitting 70 has an internal passage 71 extending the length of the fitting 70.

The body member 22 is constructed with a large internal passage to receive a sub 73 having a small lengthwise passage 74 formed therein. The passage 74 has an upper end which connects with the passage 71 to complete the fluid flow path. The passage 74 extends the full length of the sub 73 to open into a chamber 75. The chamber 75 is a pump chamber with a piston 76 to force fluid out of the chamber. The sub 73 is drilled with a second passage, this passage receiving a hollow plug 77. The plug 77 has a passage 78 in it, this being the route of flow out of the chamber 75. The passage 78 is closed at the upper end by a check valve element 79 forced against the upper end of the passage 78 by a coil spring 80. Fluid flow by the check valve 79 is outwardly through a lateral passage 81 selectively closed by a restrictive orifice 82. The orifice 82 is sized to control the flow rate. One or more can be used in the preferred embodiment.

It must be recalled that the chamber 75 has a reciprocating piston 76 in it. The piston is guided by a guide sleeve 84 (see FIG. 2E). The sleeve 84 fits around the piston to assure reciprocating movement of the piston. Appropriate seals on the exterior of the piston prevent leakage. In face, the chamber 75 is sealed so that no leakage can occur. Ideally, the piston 76 is made of a magnetic material. It has a stem 85 formed of a similar magnetic material. The stem extends through a guide 86, the guide being hollow to receive the stem. The stem is formed of a magnetic material to a certain point; then, it has a section 88 formed of non-magnetic material. This section threads to the remainder of the stem. The stem is centered within the guide 86. Typically, the guide 86 is formed of polymeric materials. The guide 86 also serves as a spool support form. As spool of wire is wrapped thereabout to form a coil serving as a first solenoid 89. There is a second solenoid 90. The two solenoids are sized in conjunction with the length of magnetic material 88 to pull the magnetic material 88 of the stem. The two solenoids are separated by a spacer 91. The two solenoids provide reciprocating movement to the piston 76. Reciprocating movement is imparted to the stem and to the piston 76. The stem 85 extends full length of the apparatus and passes through a bottom plug 92. The plug 92 is hollow, receiving the stem therethrough and aligns a reciprocating enlargement 93 at the lower end of the stem. This is received in a mating cavity in the plug.

Pumping action of the pump should be considered. There are passages 29 drilled and formed in the length of the body 22. They route electrical conductors to the solenoids 89 and 90. This furnishes electrical power to the solenoids for pump operation. The solenoids are alternately powered to provide a pumping action. Pumping action occurs as the piston 76 reciprocates in the chamber 75. Consider a compressive stroke; when this occurs, the chamber 75 is reduced in volume. This forces tracer from the chamber 75 through the passage 78, pass the check valve 79 and out through the orifice 82. On the downstroke, fluid is introduced into the chamber 75. This is because it pulls a vacuum on the passage 74. That in turn opens the check valve at the valve seat 66. That draws tracer liquid down through the passage 64. This flow path draws liquid from the passage 55, the port 54, and by the check valve element 57 in response to reduced pressure. The check valve 57 serves as a safety check valve to prevent leakage out of the equipment in the event the insert cartridge is not there. Continuing further, the downward flow path utilizes the passage 50 which receives the liquid tracer delivered from the cartridge 30. The cartridge 30 is initially full; the plug 34 is in the down position achieved after most of the tracer has been expelled. The rod 33 serves as an external indicator to signify that the cartridge has been filled. When it extends full length, it indicates that the cartridge is full. The cartridge is preferably filled with the tracer at a convenient and safe location to assure minimum spillage of the radioactive material placed in the cartridge. Moreover, this arrangement prevents spilling of the tracer at the time of charging the injector apparatus 15.

OPERATION OF THE DEVICE

Assume that the sonde 10 is lowered in a cased well to a depth where it is between perforations 16 and 17.

Assume further that the surface flow out of the well is measured and is represented by $Q_t$ defined above. The flow from the sets of perforations at 16 and 17 is represented by $Q_{16}$ and $Q_{17}$. The cross-sectional area of the cased hole is known and the cross-sectional area of the sonde 10 is known and is subtracted from the larger value to yield a net cross-sectional area. Also, the spacing between the injector orifice and detector indicated by the distance D is known. Assume that the radioactive tracer is injected at a specific instant into the fluids flowing in the well 11. Passage is observed at the detector 13 sometime thereafter, this being the transient time to cover the distance D and is represented by the symbol T. The relationship D/T yields the fluid velocity which is represented by $V_F$. Once the time T is measured, the velocity $V_F$ can then be determined. The net cross-sectional area (area within the cased well 11 minus the cross-sectional area of the sonde 10) is defined by the symbol A to assist in converting velocity to volume.

A measurement of the $V_F$ below the perforations 17 is first made. A similar measurement is made above the perforations 17. If production is obtained from both horizons, the flow velocity will be greater above the perforations 17. The flow rates at these two relative depths can be determined, and the volumetric flow rates $Q_{16}$ and $Q_{17}$ can then be determined. $Q_{17}$ is not directly determined by measurement; rather, the flow rate above the perforations 17 is determined and the flow rate attributable to the perforations 16 is subtracted to obtain the difference or $Q_{17}$. The flow rates determined in this fashion should add to provide the actual flow rate measured at the well head or $Q_t$.

An important factor in the use of the present apparatus is measurement of flow rate as described above. An alternate use is to measure the flow rate when the sonde 10 is moving. This velocity is represented by the symbol $V_S$ and it is known by the operator at the surface, being determined by the rate at which the cable 12 is pulled from the cased well 11. This can be measured at the sheave 18. There are instances in which the velocity in the upward direction of the sonde is so great that the tracer injected into the fluid flow in the well does not arrive at the detector 13. In other words, the velocity of the sonde is so great that the tracer is left behind the sonde which travels even faster. Accordingly, the operator can at that point exercise control, thereby slowing or stopping the sonde to obtain measurements of fluid velocity. By operator control and by taking measurements below and above the perforation 17 and by making the calculations described above, it can be determined whether or not the fluid flow is from or into the formations 16 and 17. Recall that it is possible for a zone to steal well fluid through the perforations. For instance, this can occur in the situation where one formation is depleted and formation pressure is nil. Assume as an easy example that the formation 16 produces 150% of the measured volume discharged at the wellhead. In this example 50% of the volume flows out through the perforations 17 into the formation which has relatively low formation pressure. In this instance, use of the present apparatus to make measurements of fluid flow velocity below and above the perforations 17 provides data which shows the flow rates. This data coupled with measurements made at the surface suggests remedial steps, for instance, plugging the perforations 17.

As will be understood, the present apparatus can be used with a packer temporarily installed at any point along the well to isolate zones. The well can be packed below the perforations 17 and that formation can then be tested to determine whether or not it can produce provided the well pressure is reduced. Many other examples and modes of operation of the present apparatus can be developed along these lines.

While the foregoing is directed to the preferred embodiment and a method of use thereof, the scope of the present disclosure is determined by the claims which follow.

What is claimed is:

1. For use in a well borehole having fluid flow therein, an apparatus for use in testing fluid flow in the well borehole, the apparatus being suspended on a cable in the borehole and comprising:

(a) a sonde suspended on a cable in a well borehole;

(b) closed chamber means adapted to receive therein a tracer fluid uniquely identifiable when flowing with well fluid flow in the borehole and comprising a detachable elongate cylindrical cartridge closed at spaced circular ends thereof and having an internal chamber for receiving tracer fluid therein;

(c) outlet valve means connected to said chamber means for controllably removing tracer fluid therefrom;

(d) pump means supported by said sonde and connected to said outlet valve means for receiving a flow of tracer fluid therefrom for pumping by said pump means; and (e) outlet metering means connected to said pump means for delivering tracer fluid through said metering means for flowing in well fluid in the borehole.

2. The apparatus of claim 1 wherein said cartridge includes a piston movably mounted within said chamber for forcing tracer fluid from said chamber.

3. The apparatus of claim 1 wherein said cartridge includes an internal check valve means preventing flow of tracer fluid thereout past said check valve means, said check valve means comprising a valve seat having a valve element closed thereagainst, and resilient means holding said valve element in the closed position.

4. The apparatus of claim 3 including means for aligning an externally located valve element upsetting means for entry past said valve seat to open said valve element and thereby permit flow from said chamber.

5. The apparatus of claim 1 wherein said sonde incorporates an internal cavity for receiving said cartridge therein to be fully enclosed and wherein said sonde supports a protruding bayonet means stabbing into said cartridge for operation of a cartridge located check valve means preventing leakage of tracer fluid therefrom.

6. The apparatus of claim 5 wherein said bayonet means incorporates check valve means therein permitting flow out through said bayonet means along an axial passage therein.

7. The apparatus of claim 6 wherein said bayonet means includes an extending probe sufficiently long to upset check vale means in said cartridge.

8. The apparatus of claim 5 including a reciprocating piston in a chamber comprising said pump means, and further including inlet and outlet check valves for controllably delivering tracer fluid thereto and therefrom, and further wherein the tracer fluid flows from said bayonet means.

9. The apparatus of claim 8 wherein said piston and chamber are serially connected with said metering means and said metering means is exposed to the exterior of said sonde for delivery of tracer fluid into fluid flow in the borehole.

10. The apparatus of claim 9 including spaced electrically powered coils for reciprocating said piston to provide pumping action.

* * * * *